United States Patent [19]

Cole et al.

[11] Patent Number: 4,917,543

[45] Date of Patent: Apr. 17, 1990

[54] WALL SYSTEM EMPLOYING EXTRUDED PANEL SECTIONS

[75] Inventors: Richard W. Cole, Nixa; Richard L. Marsh, Springfield, both of Mo.; Joseph V. Tassone, Kettering, Ohio

[73] Assignee: Dayco Products, Inc., Dayton, Ohio

[21] Appl. No.: 255,810

[22] Filed: Oct. 11, 1988

[51] Int. Cl.[4] ..... E02D 29/02; E02D 5/00

[52] U.S. Cl. ..... 405/262; 405/279; 405/281; 405/284; 256/73

[58] Field of Search ..... 405/262, 274–281, 405/284, 285; 52/483; 256/24, 59, 65, 69, 73

[56] References Cited

U.S. PATENT DOCUMENTS

| | | | |
|---|---|---|---|
| 901,241 | 10/1908 | Harold | 405/277 |
| 972,059 | 10/1910 | Clarke . | |
| 1,032,109 | 7/1912 | Buckingham | 405/279 |
| 1,067,489 | 7/1913 | Sederquist | 405/278 |
| 1,371,709 | 3/1921 | Stockfleth . | |
| 1,422,821 | 7/1922 | Boardman et al. . | |
| 1,918,886 | 7/1933 | Amand | 405/279 |
| 1,947,151 | 2/1934 | Caples . | |
| 2,099,542 | 11/1937 | Stevens | 405/278 |
| 2,698,931 | 1/1961 | McGrath . | |
| 3,247,673 | 4/1966 | Schneller . | |
| 3,420,065 | 1/1969 | Holl | 405/284 |
| 3,541,798 | 11/1970 | Schnabel, Jr. . | |
| 3,822,557 | 7/1974 | Frederick . | |
| 4,050,254 | 9/1977 | Meehen et al. | 405/285 |
| 4,099,359 | 7/1978 | Sivachenko | 52/630 |
| 4,407,612 | 10/1983 | Van Weele | 405/285 |
| 4,674,921 | 6/1987 | Berger | 405/262 |
| 4,690,588 | 9/1987 | Berger | 405/262 |

FOREIGN PATENT DOCUMENTS

| | | | |
|---|---|---|---|
| 2026578 | 2/1980 | United Kingdom | 405/284 |

*Primary Examiner*—Randolph A. Reese
*Assistant Examiner*—John A. Ricci
*Attorney, Agent, or Firm*—Joseph V. Tassone

[57] ABSTRACT

Wall systems are disclosed which employ a plurality of individual panels formed of extruded polymeric material joined in edge-to-edge relation including wale members which are vertically offset and interlocked at end portions thereof with adjacent wale members. The wall systems include connector elements for joining and interlocking the adjacent panel edges, and panels are disclosed, each having a continuous convex surface between their opposite side edges and strengthening ribs formed on a concave surface disposed opposite the convex surface thereof. A revetment system is disclosed in which a pair of wall sections are positioned in facing spaced-apart relation and joined by tie bolts extending through the wale members, to receive concrete therebetween.

18 Claims, 6 Drawing Sheets

WALL SYSTEM EMPLOYING EXTRUDED PANEL SECTIONS

BACKGROUND OF THE INVENTION

1. Field of the Invention

This invention relates to retaining walls and wall systems and more particularly to such walls and systems, including panels of extruded polymeric material, for use as sea walls, retainers, revetments, sound barriers, construction panels, room dividers, building walls, floors, ceilings, and the like.

2. Prior Art Statement

It is known to form sea walls of a plurality of panels formed of extruded PVC material and interconnected edge to edge, as shown in Berger, U.S. Pat. No. 4,674,921 issued June 23, 1987 and 4,690,588 issued Sept. 1, 1987. In Berger, panel strips of corrugated or sinusoidal shape are formed with alternating groove edges and tongue edges, permitting the panels to be interlocked along their vertical marginal edges. Wale elements are mounted along outer surfaces of the panel strips and accept tie bolts or tie rods extending to ground anchors on the opposite side of the sea wall. Berger also discloses angled strips for making corners, and connectors for joining adjacent strips in edge-to-edge relation.

Sinusoidal or corrugated sheets have been mounted in facing relation and connected or joined by tie rods, and the spaces therebetween have been filled with concrete or mortar to provide a water-tight joint, to form a revetment, as shown in Schneller, U.S. Pat. No. 3,247,673 of April 26, 1966.

Sinusoidal or corrugated panel sections have been used to make up retaining walls or sea walls, with wale elements on a front surface tied back to anchors, as shown in a number of prior patents. Caples, U.S. Pat. No. 1,947,151 of Feb. 13, 1934 shows panel sections formed with interconnecting locking vertical edges in alternating inwardly and outwardly directed portions to form a sinusoidal wall. In Caples, the interlocking ends are identical. In Frederick, U.S. Pat. No. 3,822,557 of July 9, 1974, one panel vertical edge is formed with a tongue and the opposite panel vertical edge is formed with a groove proportioned to receive the tongue of an adjacent panel.

Another example of a retaining wall made of interlocking sections of sheet material is McGrath, U.S. Pat. No. 2,968,931 of Jan. 24, 1961. In McGrath each panel section is bent into three angular portions, and each panel section is reversed when connected, edge to edge to form a sinusoidal-like pattern.

Earlier examples of wall systems having interlocking panel sections which are assembled in longitudinal alignment, with interlocking vertical edges, include Clarke, U.S. Pat. No. 972,059 of Oct. 4, 1910; Boardman et al, U.S. Pat. No. 1,422,821 of July 18, 1922; and Stockfleth, U.S. Pat. No. 1,371,709 of March 15, 1921.

It is also known to use a series of individual arcuate sections which are then joined or interconnected to form a retainer wall, as shown in Van Weele, U.S. Pat. No. 4,407,612 of Oct. 4, 1983.

While walls formed by corrugated panel sections are extensively shown in the prior art in which the corrugations or the axes of the corrugations run vertically, is also known to form panel sections in which the axes of the corrugations run horizontally, as shown in Sivachenko U.S. Pat. No. 4,099,359 of July 11, 1978. FIGS. 7 and 8 also show opposed facing pairs of corrugated sections in which the spaces therebetween may be filled with concrete to form a revetment.

It is common to use wale brackets or wale elements in combination with panel-type sea walls or retainer walls. Berger, Schnabel, Jr. and Caples show wale elements in longitudinal alignment. Schnabel, Jr., U.S. Pat. No. 3,541,798 of Nov. 24, 1970 shows individual longitudinally spaced wale elements along the wall front face. The wale elements receive tie-back rods, which rods extend through or between the panels to suitable anchors.

SUMMARY OF THE INVENTION

This invention relates to retaining wall systems particularly adapted for use as sea walls or the like, which incorporate improvements and advantages not shown in the above-identified prior art. A principal part of the wall system comprises a plurality of individual panels, preferably formed by the extrusion of polymeric material, such as PVC, or the like.

The panels are transversely arcuately curved to form a convex surface on one side and a concave surface on the opposite side. The panels are joined together in edge-to-edge relationship, either by the direct joining and interlocking of adjacent edges, or by the employment of intervening interlocking elements. Where an interlocking element is used, each of the panels may be of essentially identical construction, such as with continuous grooves formed along the opposed or lateral edges, for engagement with interfitting tongues formed on the opposed edges of intervening interlocking elements.

Where the arcuately curved panels are directly joined to each other, one panel may be formed with grooves along the lateral edges and an adjacent panel may be formed with tongues along its lateral edges proportioned to be engaged in the groove of an adjacent panel.

In another form of the invention, the panels are formed with integral ribs which extend along the length of the panel. The ribs may be for strength and/or acoustical purposes, and are formed on the inside or concavely curved surface of the panel.

The invention further comprises an improvement in wale members and in the interconnection of the wale members which add substantially to the overall strength of the wall. For this purpose, the wale members, which are generally channel or box-shaped in cross-section, are formed with interlocking longitudinally extending upper and lower walls or surfaces. When assembled, the end portions of the wale members mutually overlap and interlock with each other. The bending moments of one wale member are transmitted to the adjacent laterally extending and interlocking wale member, thereby substantially adding to the overall strength of the wall.

The wall systems of the invention are particularly adapted for use as permanent concrete forms, in forming revetments. In such instances, the arcuately curved sections or panels of one wall section are laterally offset from the facing arcuately curved sections of an adjacent wall section. When the panels of these wall sections are suitably spaced and joined, such as by tie rods, they form permanent forms between which concrete may be placed or poured to form a strong revetment.

The panels making up the walls of this invention have high versatility in that, in one embodiment, each of the panels may be identical and linked or joined in edge-to-edge alignment by suitable intervening connector elements. The connector elements provide versatility and permit the panels sections to be arranged in varying configurations, and also provide for defined wall corners or angles, as required.

In another aspect of the invention, the panels making up the wall systems of this invention have a convex surface and an opposite concave surface with the concave surface having one or more integral ribs thereon. In a preferred embodiment of the invention, a plurality of ribs in the form of three ribs are uniformly spaced apart on the concave side and extend transversely to a common depth.

In further embodiments of the invention, the panels may be configured in such a way as to eliminate the need for intervening connectors. Thus, the panel edges may be configured in the form of alternating tongues and grooves to permit the panels to be directly interlocked one to the other. Such panels may be formed either with tongues or grooves at the vertical edges, and then alternated for interlocking, or the panels may be formed with the tongue along one edge and a groove along the other edge, eliminating the need for using alternate panels for interlocking.

Panels making up a wall of this invention may be suitably attached to posts and supporting rails, where the rails may take the place of the interconnected and interlocked wale members, where maximum strength may not be required. Such a construction may have advantage in the erection of a sound deflecting wall, construction wall, temporary wall, or a retaining wall where wale elements and tiebacks may not be required. Also, such arrangement has the advantage of exposing the face of the wall, free of wale members.

In a further aspect of the invention, the panels need not be run vertically. In some instances, it may be desirable to run the panels horizontally between supporting posts. In such instance, the advantage of the interlocking panels or interlocking connector elements may be enjoyed in a low-cost and easy-to-erect wall system.

It is accordingly an object of this invention to provide a retaining wall system, such as a sea wall or the like, employing a plurality of substantially identical, extruded polymeric panel sections, joined by interlocking intermediate connector elements.

Another object of the invention is the provision of a wall, as outlined above, incorporating wale members which longitudinally interlock with each other along overlapping end portions thereof.

A further object of the invention is the provision of a wall, as outlined above, in which individual panels are formed with generally vertically extending ribs formed on the concave side of the panel.

Another object of the invention is the provision of a panel for use with a plurality of identical panels in making up a sea wall or a retainer wall or the like, in which the panel is formed of extruded material and is arcuately shaped to provide high strength against buckling and bending.

Another object of the invention is the provision of a wall system utilizing a plurality of individual panels, and supported and strengthened by wale members, in which the wale members are longitudinally interlocked at the end portions thereof, one to another, in overlapping relation.

A still further object of the invention is the provision of a wall system, useful as a revetment, in which a pair of walls are positioned in spaced, opposed relation, in which curved panels have the concave sides thereof opposed and facing each other, joined by tie rods, and defining a space into which concrete may be poured to form a completed wall system.

Other objects, uses and advantages of this invention are apparent from a reading of this description which proceeds with reference to the accompanying drawings forming a part thereof and wherein:

BRIEF DESCRIPTION OF ACCOMPANYING DRAWINGS

DESCRIPTION OF PREFERRED EMBODIMENTS

Figure 1:
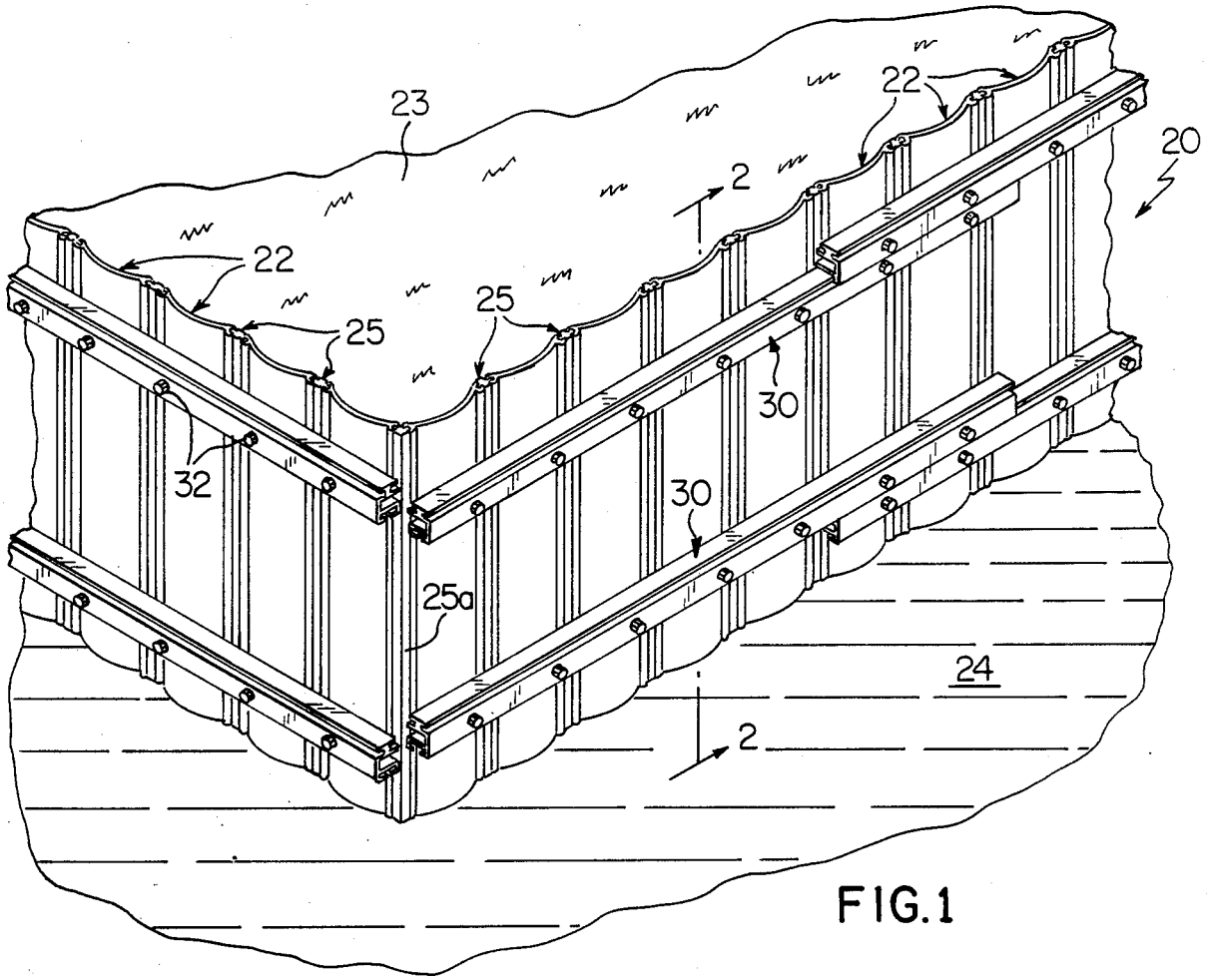
FIG. 1 is a perspective fragmentary view of a retaining wall system made in accordance with a first embodiment of this invention used as a sea wall.
Figure 2:
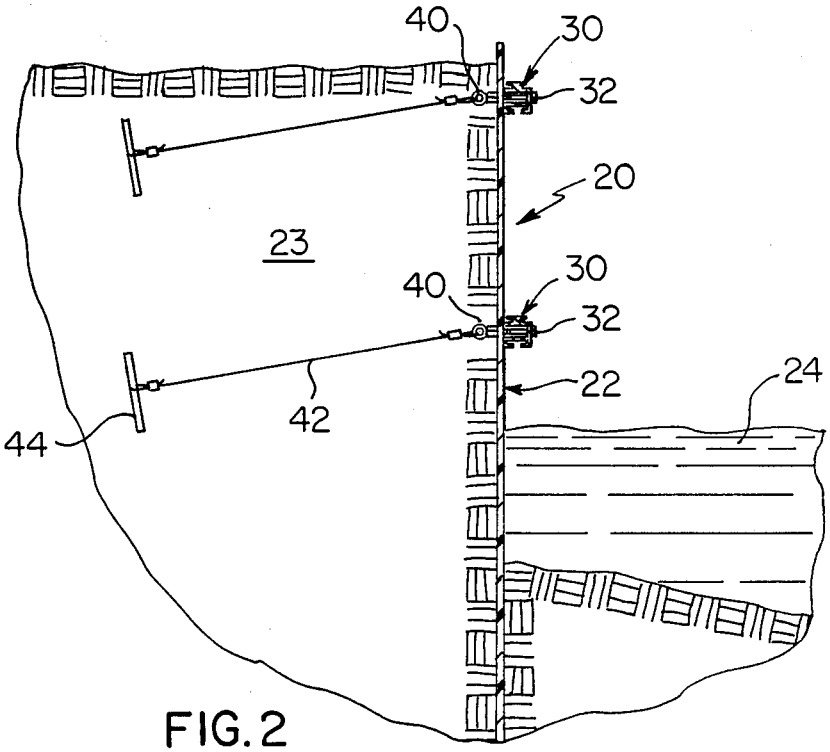
FIG. 2 is a vertical section through the wall looking generally along the line 2—2 of FIG. 1.

A retainer wall system in the form of a sea wall is shown at 20 in FIGS. 1-4 as including a plurality of essentially identical extruded panels 22 formed of polymeric material, such as PVC. The wall 20 forms a retainer for the soil 23 on the back side of the panels 22 with the sea 24 at the front surface. The panels 22, as shown in FIG. 2, extend vertically with lower ends received in the subsoil below the lower level of the water at the shoreline. The panels 22 are joined in edge-to-edge relation by extruded interlocking connector elements 25, also formed of the polymeric material, such as PVC, as shown in FIG. 5.

Figure 3:
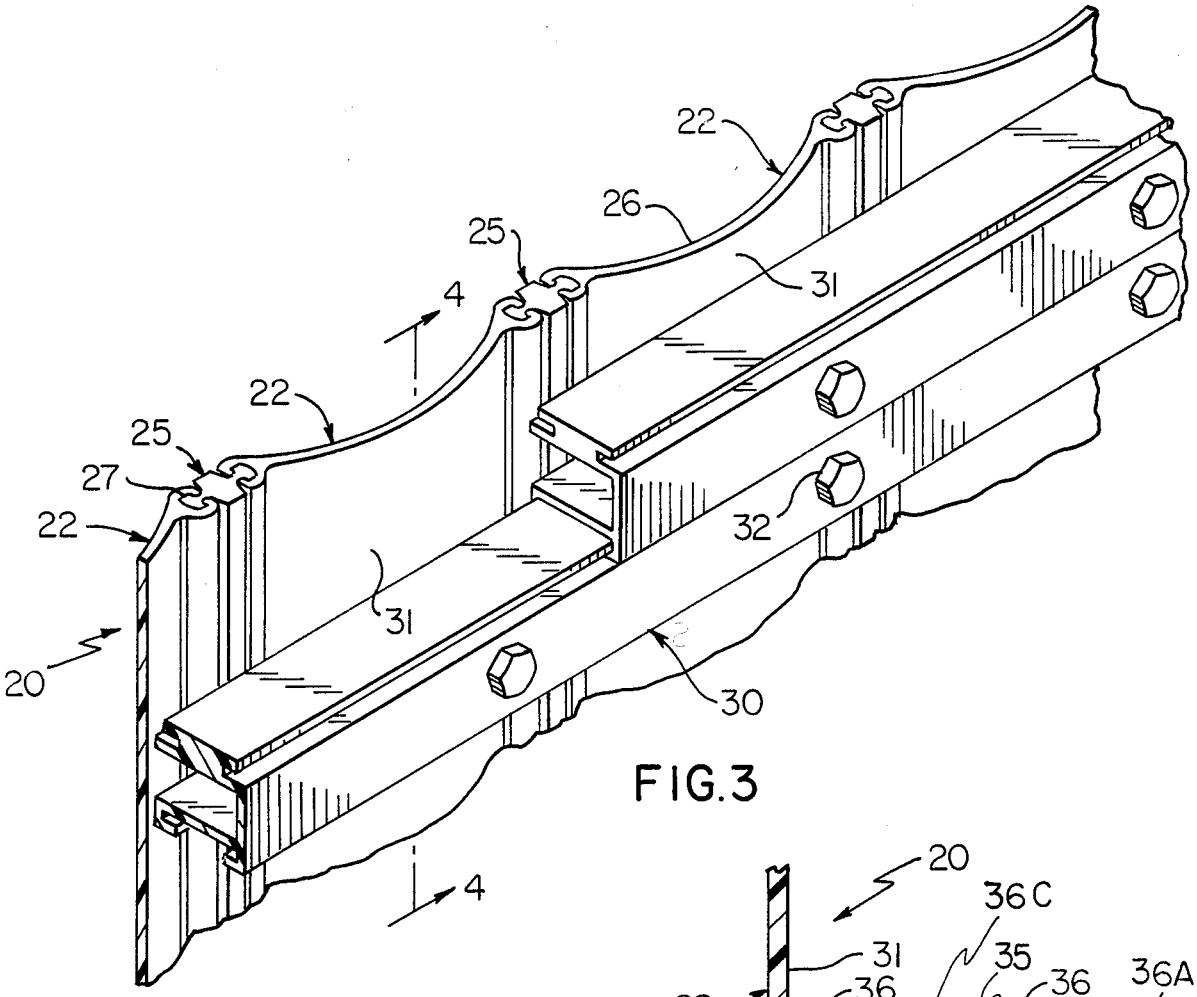
FIG. 3 is an enlarged fragmentary perspective view of a portion of the retaining wall of FIGS. 1 and 2, showing the interconnected wale members.

The individual panels 22 each have an arcuately curved body 26 which, over the major transverse extent, is formed of uniform thickness, such as by extrusion, to form a convex surface on one side and a concave surface on the other side. The arcuate portion of the body has the shape of a segment of a cylinder. The panel 22 terminates along vertical margins or edges which form connector or locking portions, either in the form of locking tongues or tongue-receiving grooves. In the embodiment as shown in FIGS. 1-3, the panels 22 have widened vertical edges which define interlocking grooves 27, as best shown in FIG. 5.

Figure 5:
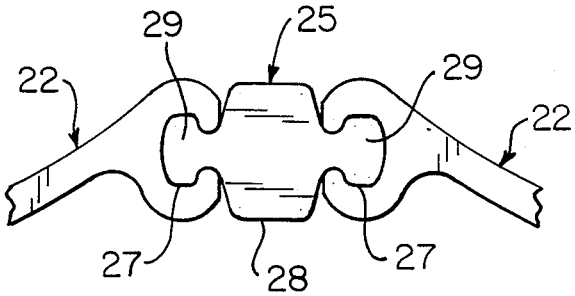
FIG. 5 is a fragmentary end view of one form of a connector element employed with this invention.

The adjacent facing grooves 27 of adjacent panels are interconnected by the interlocking connector element 25, as shown in FIG. 5. The connector element 25 is formed with a body 28 defining a pair of oppositely facing identical tongues 29 which extend along the length of the element. The tongues 29 are proportioned to be received in an associated adjacent groove 27 of a panel 22. In this manner a plurality of the panels and connectors may be assembled in generally vertical relation, to form the wall 20 as shown in FIG. 1, with the respective concave panel sides thereof facing the land mass to be retained, and the convex side facing the water, in the case of a sea wall.

Figure 6:
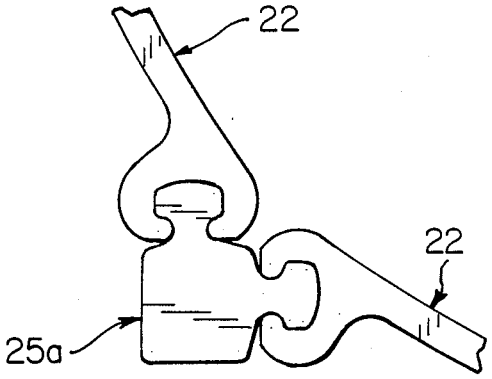
FIG. 6 is an end view of a corner-type connector element.

The use of connector elements 25 permits versatility in the use of the panels 22 to make up a wall. A right-angle connector element 25*a* of FIG. 6 may be used to form a corner, as shown in FIGS. 1 and 6. In the element 25*a*, the connector or locking portions are at about 90° to each other.

Figure 8:
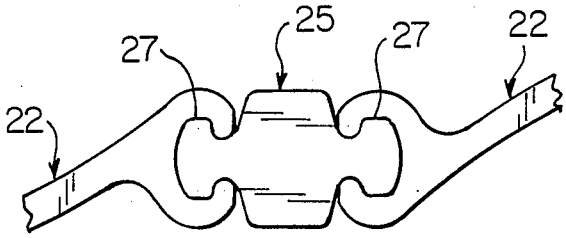
FIG. 8 is a fragmentary detail showing how the connector element of FIG. 5 is employed when the curvature of adjacent panels is reversed.
Figure 7:
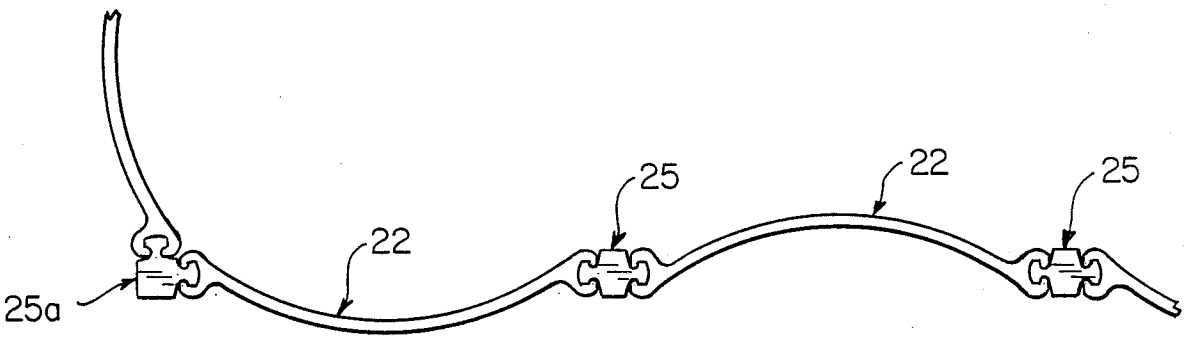
FIG. 7 is a fragmentary view of a plurality of panels in which the curvature of alternate panels are reversed, using the connector member of FIG. 5.

Also, the connector elements 25 and the associated panel edge slots 27 have a neutral orientation, thereby permitting alternate panels 22 to be reversed, as illustrated in FIGS. 7 and 8. Such an arrangement may be desirable where the panels are to be used to make an exposed wall, to provide a decorative appearance, or introduce variety, where maximum strength in one direction only is not a paramount consideration.

The assembled panels 22 and connector elements 25 are retained and supported by a plurality of transversely extending wale members 30. The wale members 30 may also be formed of extruded polymeric material, such as PVC, and are received against the outer convex surfaces 31 of the panels 22. The wale members 30 receive conventional tie bolts or rods 32 therethrough, also preferably made of suitable polymeric material, such as PVC. The wale members may be of any convenient length, preferably spanning a plurality of assembled panels 22 and connector elements 25.

The wale members 30 are channel-shaped to form a hollow interior closed by a transversely extending vertical back wall 33, a horizontal top wall 34, and a parallel horizontal bottom wall 35. The tie bolt 32 extends through the back wall 33 and the hollow interior between the top and bottom walls 34, 35 and through the body 26 of the adjacent panel, so that the member abuts the adjacent convex panel sides 31 at the inner edges of the top and bottom walls.

The top and bottom walls of the wale members 30 are provided with means for mutually interlocking the overlapping end portions of adjacent members, so that the loads and bending moments applied to one wale member may, in part, be transferred to the overlapping member. The interlocking means is in the form of interfitting flange portions formed respectively on the top and bottom walls.

The top wall 34 is formed with a neck 35 terminating in a pair of flanges 36 which extend parallel to the wall 34 and which define flange-receiving slots 36*a* with the outer surface of the wall 34. The flanges 36 on the neck 35 terminate at square or flat ends 36*b* which are spaced apart a distance less than the depth of the member as measured from the outer surface 33*a* of the back wall to the open side of the member 30. The outside upper surface 36*c* is flat and is parallel to the opposed inside surface 34*a* of the top wall.

The bottom wall 35 also has a flat inside surface 35*a* parallel to the surface 34*a*. A slot 37 is formed by the outside wall surface 35*b* and by a pair of inwardly-directed flanges 38. The flanges also terminate in opposed edges 37*a* which are flat and normal to the surface 35*b*. The outer flange 38*a* extends inwardly from an extension 33*a* of the outer wall, while the inner flange 38*b* extends inwardly from a connector segment 39, the inner surface of which abuts the panel surface 31. The vertical spacing of the slots 37 as defined by the flanges 38 is no more than sufficient to receive and form a tight fit with the flanges 36.

The wale members 30 may thus be considered as having a tongue form on one wall and a groove on the opposite wall, in which the grooves are proportioned to receive the tongues of an overlapping member 30.

Figure 4:
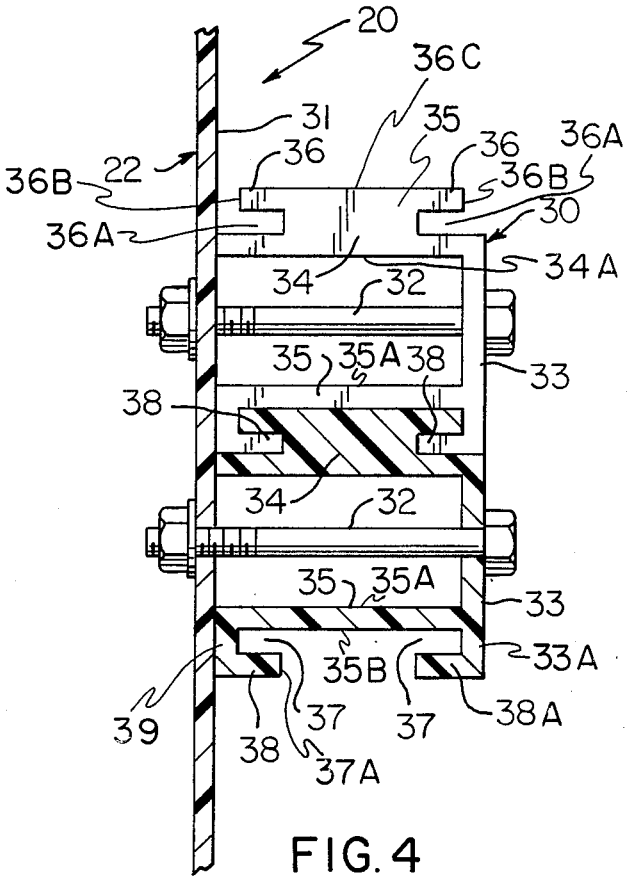
FIG. 4 is an enlarged fragmentary vertical section through one of the wale members showing, in elevation, a longitudinally interconnected wale member, looking generally along the line 4—4 of FIG. 3.

As shown in FIGS. 3 and 4, the overlapping end portions of the wale members are firmly interlocked in a common plane with respect to the adjacent convex surfaces 31 of the panels, one above the other. In this manner, bending moments and loads applied to or carried at one location on the wall 20 are distributed transversely to other locations which would not otherwise see such moments or loads.

Either a single row of wale members may be used or two or more such rows may be employed, as shown in FIGS. 1 and 2. The tie bolts 32 of either or both such rows may be formed with eyes 40 and tied back by rods or cables 42 to ground anchors 44, as shown in FIG. 2. Again, the rods, cables and ground anchors may be formed of polymeric material.

Figure 11:
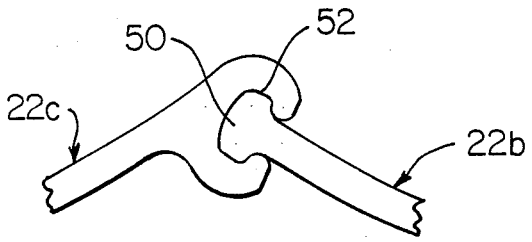
FIG. 11 is an enlarged fragmentary view showing the interconnection of a pair of adjacent panels made according to the embodiment of FIG. 10.
Figure 10:
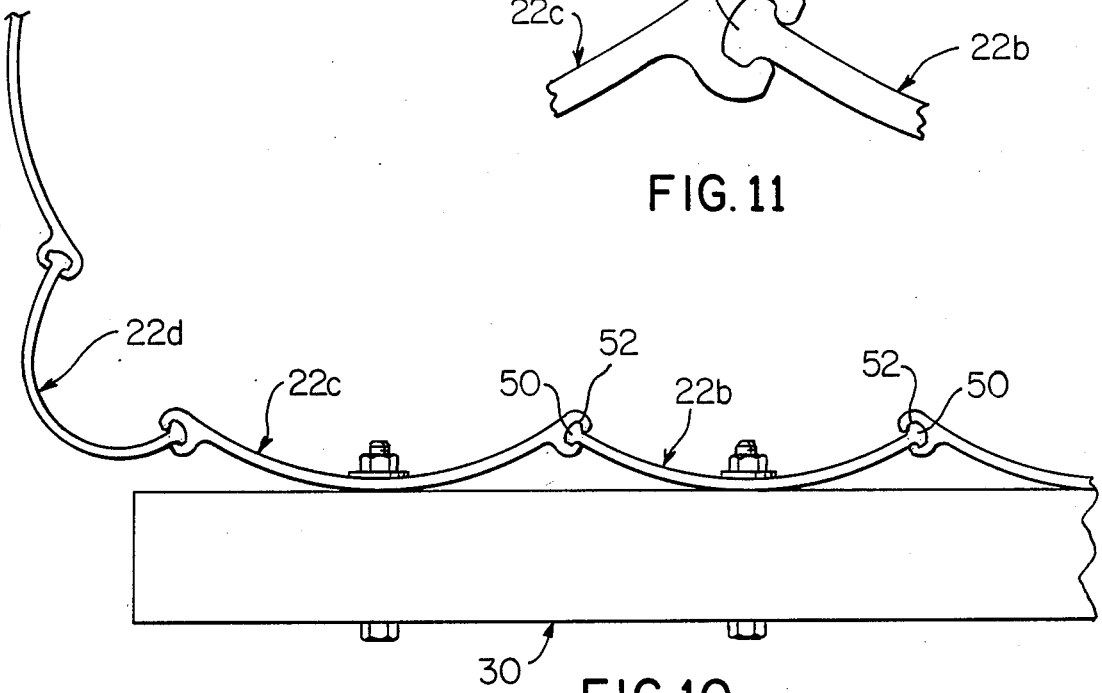
FIG. 10 is a fragmentary top view of a modified form of the wall of this invention employing alternate panels formed either with tongues or grooves, such that tongued panels are alternated with grooved panels, and further showing a modified panel for forming a corner.
Figure 12:
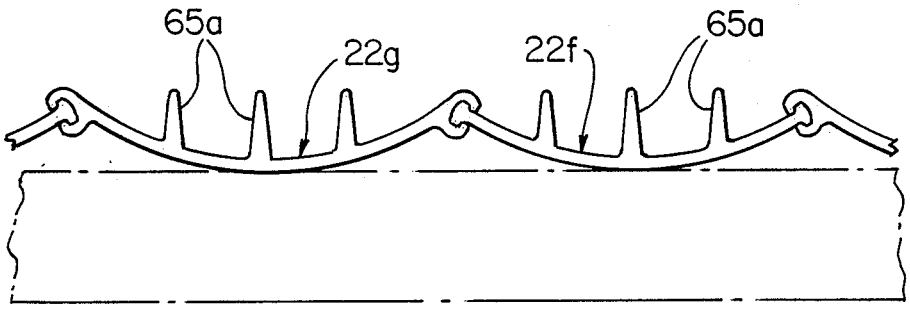
FIG. 12 is a fragmentary plan view of a modified form of the panel of FIGS. 10 and 11 incorporating strengthening ribs on the concave surface thereof.

FIGS. 10-12 illustrate another preferred embodiment of the wall system in which individual panels 22*b* are formed with only tongues 50 along the opposite marginal edges, and mating panels 22*c* are formed with mating grooves 52 along the marginal edges. The wale members 30 previously described may be used with the wall panels of the embodiment, as shown in FIG. 10. In making up a complete wall system, the panels 22*b* and 22*c* are alternated and interlocked directly to each other as they are inserted into the wall. Corners may be formed by a corner panel 22*d* specially adapted for this purpose.

Figure 13:
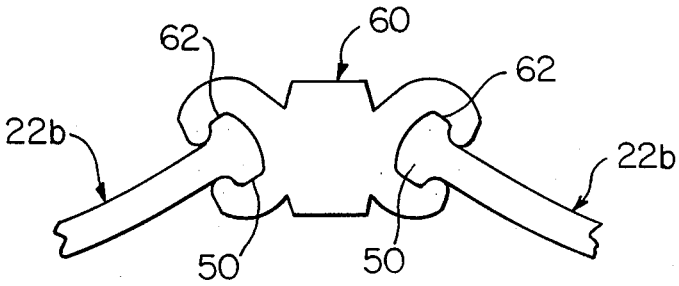
FIG. 13 is an enlarged end view of a interlocking connector element formed with transversely spaced grooves permitting the interconnection of an adjacent pair of the tongue portions of panels constructed according to the embodiment of FIGS. 9 and 10.

FIG. 13 illustrates a connector element 60 particularly adapted to connect the tongues of adjacent panels 22*b* without the use of an adjoining panel 22*c*. In the case of the element 60, the opposite grooves 62 are not on a neutral axis as in the elements 25, but are angled to receive the correspondingly angled tongues 50 of the panels 22*b*.

Figure 9:
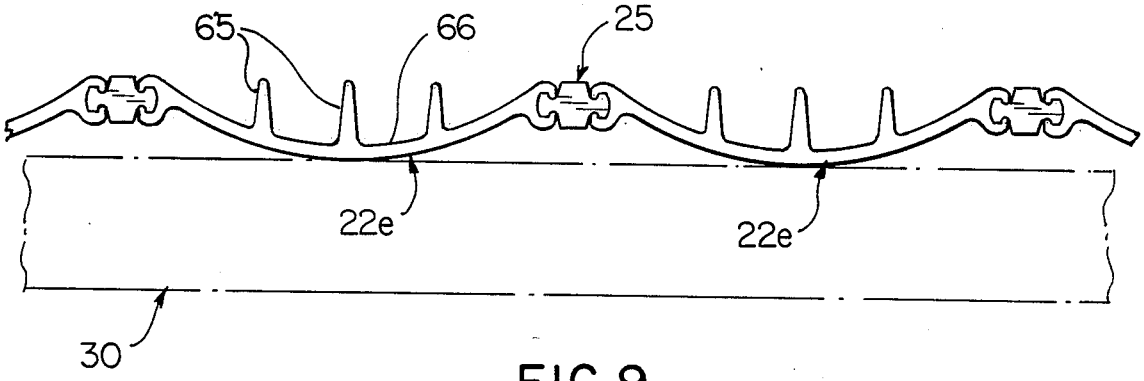
FIG. 9 is a top plan view, of another preferred embodiment of a wall system in which the concave surface of the panel is provided with a plurality of transversely extending strengthening ribs. The panels of the embodiment of FIG. 9 are particularly adapted to employ the interlocking connector elements of FIGS. 5, 6 and 8.
Figure 16:
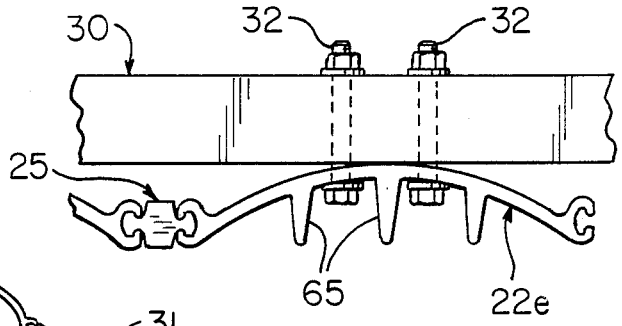
FIG. 16 is an enlarged fragmentary plan view showing a preferred manner of interconnecting panels of the embodiments of FIGS. 9 and 15 to a wale member.

In many circumstances it may be desirable to provide a panel with enhanced strength, or for acoustical purposes as shown in FIG. 9. The panel 22*e* is extruded with a plurality of integral ribs 65 extending laterally from its concave surface 66. While three ribs are shown, the ribs may be greater or fewer in number within the scope of this invention. The ribs 65 may extend laterally to a common depth corresponding to a chord line across the open side of the panel 22*e*. When the modified panels 22*e* are used with the wale members 30, it may be desirable to join the panels to the wale members by pairs of tie bolts 32, as shown in FIG. 16.

The interlocking panels as shown in FIG. 10 and described above may also be provided with strengthening or acoustical ribs 65*a* on the panels 22*f* and 22*g* of FIG. 12. In other respects, these panels may be identical to panels 22*b* and 22*c*, respectively.

Figure 14:
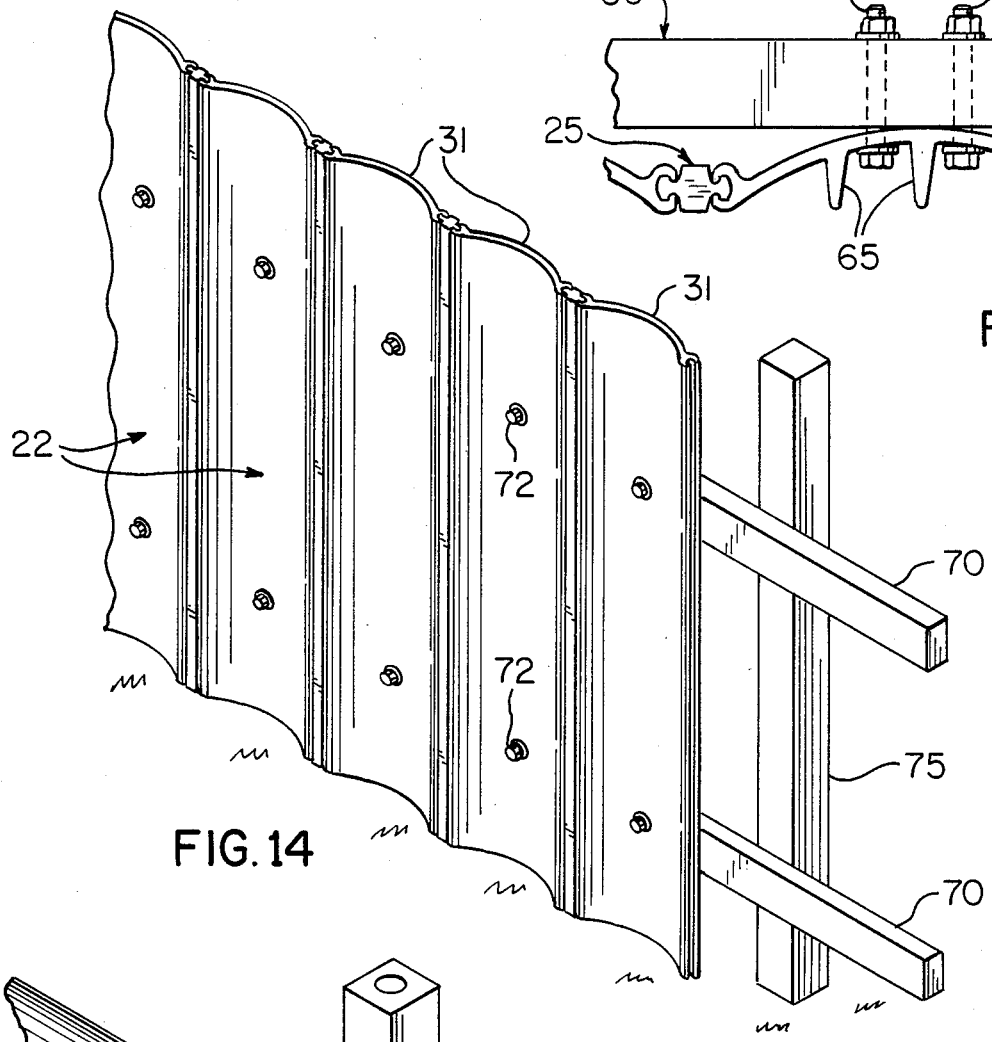
FIG. 14 is a fragmentary perspective front view of a sea wall or retaining wall according to the embodiment of FIGS. 1 or 3, in which supporting posts and rails are mounted on the land side of the wall.

In some instances, it may be desirable to support the wall on support posts and rails on the convex side 31 of the panels. Such an arrangement is illustrated in FIG. 14. The horizontal rail members 70 may be the wale members 30 as previously described, and in other instances, may advantageously be simple wood or metal support rails, secured to the wall panels by bolts 72. The rails 70 may be secured to vertical posts 75 driven into the ground. The arrangement of FIG. 14 provides versatility in such instances where ground anchors are not required, such as for free-standing walls, sound deflector walls, privacy enclosures and the like. The wall systems of FIG. 14 presents the concave side of the panels to view, free of wale members or rails.

Figure 17:
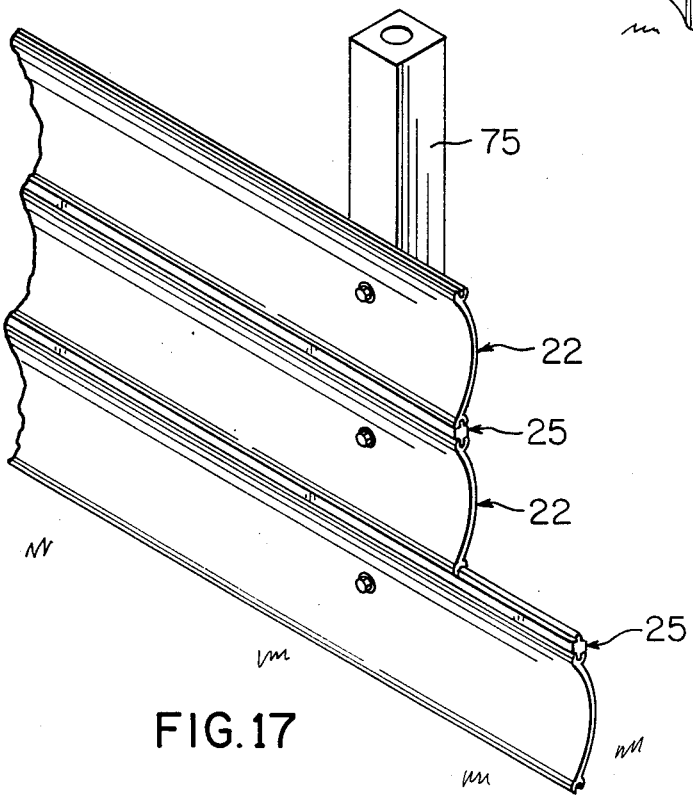
FIG. 17 is a fragmentary perspective view, somewhat similar to FIG. 14, showing the use of the individual panels running horizontally of the posts to form a wall.
Figure 15:
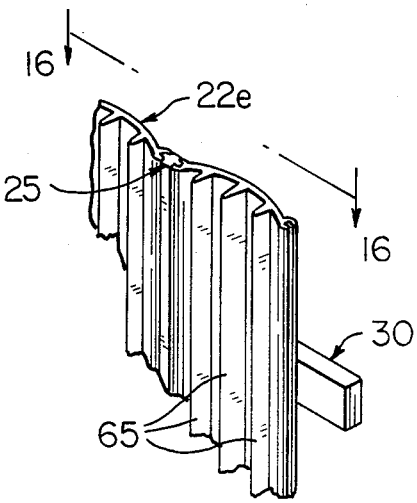
FIG. 15 is a fragmentary perspective of a wall and supporting wale members made in accordance with the embodiment of FIG. 9.

It is not necessary that the panels be assembled vertically, although such an arrangement is preferred for soil retention or for sea walls. However, in other instances, it may be satisfactory or desired to run the panels horizontally, as shown in FIG. 17. In FIG. 17, the panels 22 and connector elements 25 are positioned horizontally one above the other and are connected by suitable bolts to vertical posts 75.

Figure 18:
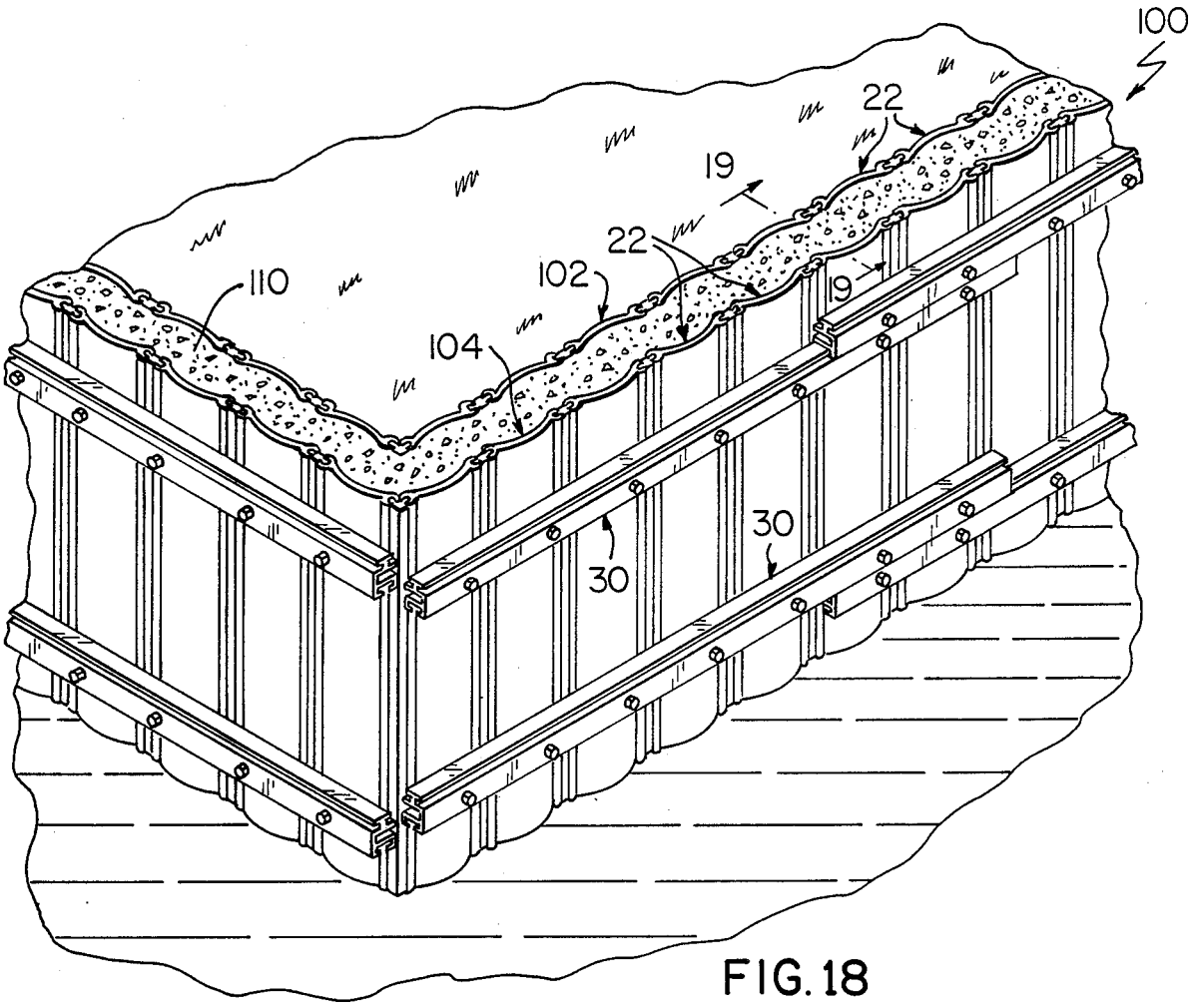
FIG. 18 is a perspective view of a further preferred embodiment of a wall system in accordance with this invention in which a pair of wall sections are positioned in spaced-apart relation, providing forms between which concrete may be poured to form a revetment.
Figure 19:
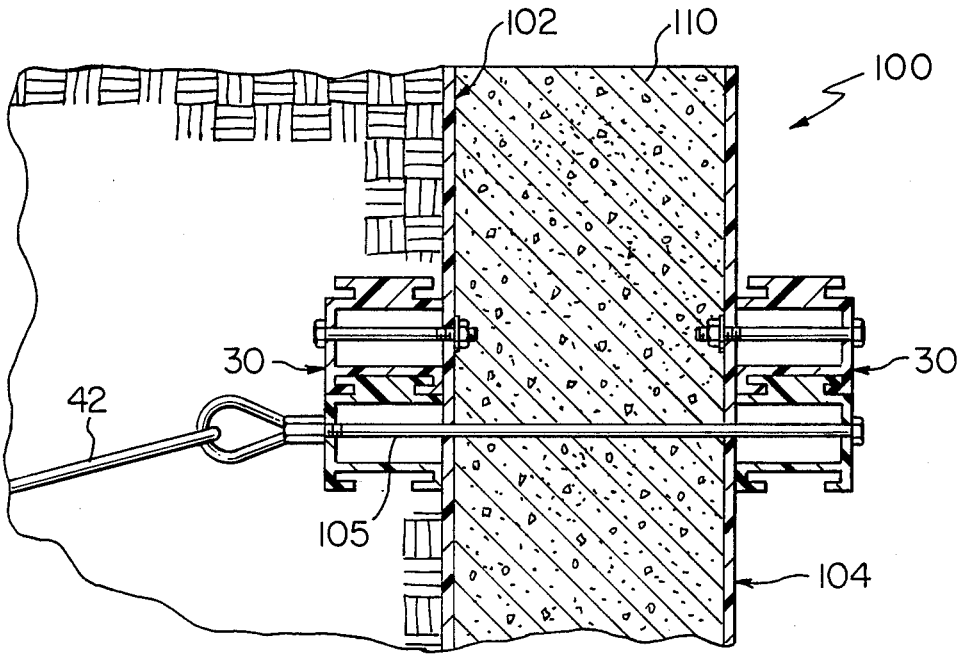
FIG. 19 is a fragmentary enlarged section taken generally the along the line 19—19 of FIG. 18.

As previously identified, the wall systems of the present invention are particularly adapted to form very strong revetments, such as for sea walls and the like. Such a dual wall system is illustrated generally at 100 in FIGS. 18 and 19. The wall system 100 includes an inner wall section 102 and an essentially identical outer wall section 104. Each of the wall sections 102, 104 may be made essentially in accordance with the teachings directed to the wall 20 of FIGS. 1–5 herein, except that the panels 22 of the individual wall sections 102 and 104 are positioned in spaced-apart facing relation with the concave surfaces of the panels positioned generally opposite each other. The panels of the wall sections may be tied together by common transversely extending tie rods 105 as illustrated in FIG. 19, extending from the wale members 30 on the outside of the wall section 104 to the corresponding members 30 on the inside of the wall section 102. The tie rods 105 may, like the tie bolts 32, be connected back to anchors by cables 42 in the manner illustrated in FIG. 2.

The wall sections 102 and 104 define an open space therebetween which may be filled with concrete 110, as shown in FIG. 19. In this manner, the wall sections 102 and 104 form permanent forms for the concrete 110, thereby providing an erosion resistance and environmentally safe surface for the concrete while the concrete synergistically provides rigidity to produce a structure such as a revetment.

It will therefore be seen that this invention provides versatile wall systems by means of which a plurality of individual extruded panels may be connected or joined together, with wale members, to form strong and effective retaining walls, sea walls, and the like.

While the forms of this invention now preferred have been illustrated and described as required by the Patent Statute, it is to be understood that other forms may be utilized and still fall within the scope of the appended claims, wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a retainer wall for use in retaining soil or as a sea wall, in which a plurality of individual panels formed of extruded plastic material are positioned in lateral side-by-side relation and in which generally vertical adjacent marginal edges of said panels are interconnected to form a wall, the improvement comprising a plurality of wale members formed of extruded plastic material and positioned along one side of said wall laterally of said panels, said wale members having overlapping and mutually interlocking end portions for laterally transferring loads and bending moments between adjacent said wale members, and having mutually interengageable laterally extending interlocking flanges for transmitting bending moments between interlocked said members.

2. The wall of claim 1 in which said wale members are formed with outwardly turned flanges along one longitudinal side and inwardly turned flanges along an opposite longitudinal side proportioned to interengage with said outwardly turned flanges of an adjacent overlapping said wale member.

3. The wall of claim 1 in which said panels are formed with grooved vertical edges, and interlocking members connecting adjacent said panels.

4. The wall of claim 1 in which each of said panels has a convex surface and an opposite concave surface.

5. The wall of claim 4 in which each of said panels comprise a plurality of longitudinally extending ribs from said concave surface.

6. The wall of claim 5 in which said ribs are three in number and which extend from said concave surface to a common depth.

7. In a retainer wall system including an assembly of individual generally vertically extending panels joined together in edge-to-edge relation, and wale members extending along one side of said assembled panels and connected to said panels, the improvement in wale members wherein wale members are interlocked to each other in partially overlapping relation, and have means thereon defining tongue portions along a side thereof and groove portions along another side thereof, said tongue portions being proportioned to receive said groove portion of an overlapping said wale member for transmitting bending moments therebetween.

8. The wall system of claim 7 in which said panels are transversely curved with a concave side and a convex side, and integral rib means extending the lengths of said panels on said concave side thereof.

9. The wall system of claim 7 further including interconnecting elements joining the vertical edge of one panel to the adjacent vertical edge of an adjacent said panel.

10. The retainer wall system of claim 7 wherein said plurality of panels comprises a first wall section, and further comprising a second plurality of said panels forming a second wall section positioned in facing relation to said first wall section and having its said wale members thereof extending along a side thereof opposite to the wale members of said first wall section and defining a space therebetween to receive a filler material.

11. The wall system of claim 10 in which each of said panels is formed as a section of a cylinder with a concave side and a convex side, and in which said concave sides of the panels of each said wall section are in mutually facing relation.

12. The retainer wall system of claim 10 further comprising tie rods extending transversely between said wall sections connecting the wale members of the first section to the wale members of the second section.

13. The wall system of claim 11 further comprising a tie rod for each facing panel pair extending in the space therebetween and connecting at one end thereof to a wale member at said first wall section and at another end thereof to a wale member at said second wall member.

14. The wall system of claim 7 in which said panels have mutually interlocked adjacent vertical edges.

15. The wall system of claim 10 in which the panels of each said wall sections have mutually interlocked adjacent vertical edges.

16. A wall system in which a plurality of individual and generally identical vertically elongated panels are supported by wale members along a face surface thereof, and in which said system includes means joining the vertical edge of one panel with the adjacent vertical edge of another panel, and tie backs extend through said wale elements to ground anchors at a side of said panels opposite from said wale elements, the improvement comprising said panels, wale elements, tie backs and anchors formed of polymeric material, and said wale elements are vertically offset and longitudinally overlapped and have flanges which are interconnected at the overlapped portions with flanges of an adjacent overlapping wale element.

17. In a retainer wall for use in retaining soil or as a sea wall, in which a plurality of individual panels formed of extruded plastic material are positioned in lateral side-by-side relation and in which generally vertical adjacent marginal edges of said panels are interconnected to form a wall, the improvement comprising a plurality of wale members positioned along one side of said wall laterally of said panels, adjacent said wale members being vertically offset and having overlapping and end portions with adjacent said member being vertically offset and interlocked with the end portions of one member being mutually interlocked with the end portion of an adjacent said member for laterally transferring loads and bending moments between adjacent said wale members, and tie bolts connecting said wale members to said panels.

18. In a retainer wall for use in retaining soil or as a sea wall, in which a plurality of individual panels formed of extruded plastic material are positioned in lateral side-by-side relation and in which generally vertical adjacent marginal edges of said panels are interconnected to form a wall, the improvement comprising a plurality of wale members positioned along one side of said wall laterally of said panels, said wale members each having a generally channel-shaped body with the open side thereof facing said panels, an outwardly flanged portion along one of the sides thereof and an inwardly flanged portion along the opposite side proportioned to mate with the corresponding outwardly flanged portion of a vertically adjacent overlapping said wale member, said wale members being vertically overlapped and mutually interlocked at said flanged portions for laterally transferring loads and bending moments between adjacent said wale members.

* * * * *